US012660967B2

(12) United States Patent
Wu et al.

(10) Patent No.: US 12,660,967 B2
(45) Date of Patent: Jun. 23, 2026

(54) CONTROL METHOD FOR INTELLIGENT TOILET COVER BASED ON SINGLE INFRARED SENSOR

(71) Applicant: Duanlong Wu, Xiamen (CN)

(72) Inventors: Dehuang Wu, Xiamen (CN); Zhenguo Zhang, Xiamen (CN)

(73) Assignee: XIAMEN OLT. CO., LTD., Xiamen (CN)

( * ) Notice: Subject to any disclaimer, the term of this patent is extended or adjusted under 35 U.S.C. 154(b) by 43 days.

(21) Appl. No.: 18/748,117

(22) Filed: Jun. 20, 2024

(65) Prior Publication Data

US 2024/0335069 A1 Oct. 10, 2024

Related U.S. Application Data

(63) Continuation of application No. PCT/CN2022/123534, filed on Sep. 30, 2022.

(30) Foreign Application Priority Data

Dec. 21, 2021 (CN) ..... 202111569967.8

(51) Int. Cl.
*A47K 13/10* (2006.01)

(52) U.S. Cl.
CPC ..... *A47K 13/10* (2013.01)

(58) Field of Classification Search
CPC ..... A47K 13/10; A47K 13/00; A47K 13/24; G05B 19/04
USPC ..... 4/241.1, 243.1, 246.1, 241
See application file for complete search history.

(56) References Cited

U.S. PATENT DOCUMENTS

| | | | | |
|---|---|---|---|---|
| 9,594,500 | B2 * | 3/2017 | Clements | G06F 3/017 |
| 10,244,904 | B2 * | 4/2019 | Zhao | G01S 13/88 |
| 11,014,111 | B2 * | 5/2021 | Wang | E03D 11/12 |
| 2017/0258281 | A1 * | 9/2017 | Zhao | A47K 13/10 |

FOREIGN PATENT DOCUMENTS

| | | | | |
|---|---|---|---|---|
| CN | 108113563 | A * | 6/2018 | A47K 13/302 |
| CN | 108354501 | A * | 8/2018 | A47K 13/28 |
| CN | 108420352 | A * | 8/2018 | E03D 9/05 |
| CN | 108547362 | A * | 9/2018 | E03D 11/06 |
| CN | 106108760 | B * | 11/2018 | G06V 10/30 |
| CN | 109138093 | A * | 1/2019 | A47K 13/24 |
| CN | 109394058 | A * | 3/2019 | A47K 13/12 |
| CN | 110292326 | A * | 10/2019 | A61B 10/0038 |
| CN | 110477795 | A * | 11/2019 | A47K 13/10 |

(Continued)

*Primary Examiner* — Lori L Baker

(57) ABSTRACT

A control method of an intelligent toilet cover based on a single infrared sensor includes the following steps: detecting a presence of a human body by an infrared sensor (130), and transmitting detected signal to a first control module (101) to control a second opening/closing mechanism to open the toilet cover (12), wherein the infrared sensor (130) has a first sensing distance range; controlling a sensing distance range of the infrared sensor (130) to shorten the sensing distance range from the first sensing distance range to a second sensing distance range; and sensing a hand motion signal by the infrared sensor (130), and transmitting the hand motion signal to the first control module (101) to control a first opening/closing mechanism to open a seat (11) or perform flushing.

9 Claims, 3 Drawing Sheets

(56) References Cited

FOREIGN PATENT DOCUMENTS

| | | | | | |
|---|---|---|---|---|---|
| CN | 110547718 | A | * | 12/2019 | A47K 13/24 |
| CN | 110714512 | A | * | 1/2020 | G01D 21/02 |
| CN | 110731720 | A | * | 1/2020 | A47K 13/30 |
| CN | 110833354 | A | * | 2/2020 | A47K 13/302 |
| CN | 111513619 | A | * | 8/2020 | A47K 13/24 |
| CN | 111549877 | A | * | 8/2020 | E03D 11/02 |
| CN | 111616632 | A | * | 9/2020 | A61G 9/003 |
| CN | 111714022 | A | * | 9/2020 | G01V 9/00 |
| CN | 111839325 | A | * | 10/2020 | A47K 13/24 |
| CN | 111920332 | A | * | 11/2020 | A47K 13/24 |
| CN | 112971580 | A | * | 6/2021 | A47K 13/302 |
| CN | 113359523 | A | * | 9/2021 | E03D 5/105 |
| CN | 113520201 | A | * | 10/2021 | A47K 13/10 |
| CN | 113966971 | A | * | 1/2022 | A47K 13/24 |
| CN | 114326445 | A | * | 4/2022 | A47K 13/10 |
| CN | 114365963 | A | * | 4/2022 | A47K 13/10 |
| CN | 114371636 | A | * | 4/2022 | A47K 13/10 |
| CN | 114587175 | A | * | 6/2022 | A47K 13/24 |
| CN | 216973631 | U | * | 7/2022 | A62C 31/28 |
| CN | 114859767 | A | * | 8/2022 | G05B 19/04 |
| CN | 217244044 | U | * | 8/2022 | A47K 7/08 |
| CN | 115198851 | A | * | 10/2022 | E03D 5/105 |
| CN | 116145778 | A | * | 5/2023 | E03D 9/00 |
| CN | 116439595 | A | * | 7/2023 | A47K 13/00 |
| CN | 116662740 | A | * | 8/2023 | E03D 9/00 |
| CN | 116677056 | A | * | 9/2023 | E03D 9/00 |
| CN | 116898313 | A | * | 10/2023 | A47K 11/04 |
| CN | 117032044 | A | * | 11/2023 | A47K 13/10 |
| CN | 117492386 | A | * | 2/2024 | G05B 19/04 |
| CN | 118161083 | A | * | 6/2024 | A61L 2/10 |
| CN | 118187225 | A | * | 6/2024 | A47K 13/247 |
| CN | 118207943 | A | * | 6/2024 | G06T 7/0012 |
| CN | 118581962 | A | * | 9/2024 | G05B 19/04 |
| CN | 118806133 | A | * | 10/2024 | A47K 13/24 |
| CN | 118902315 | A | * | 11/2024 | A47K 13/24 |
| CN | 113796765 | B | * | 3/2025 | G01F 22/00 |
| CN | 120042256 | A | * | 5/2025 | A47K 13/10 |
| CN | 120174950 | A | * | 6/2025 | G06V 10/14 |
| EP | 0935942 | A2 | * | 8/1999 | A47K 13/10 |
| WO | WO-2022166507 | A1 | * | 8/2022 | A47K 13/24 |

* cited by examiner

CONTROL METHOD FOR INTELLIGENT TOILET COVER BASED ON SINGLE INFRARED SENSOR

TECHNICAL FIELD

This disclosure relates to a control method for an intelligent toilet cover based on single infrared sensor.

BACKGROUND

At present, the automatic lifting and lowering cover of intelligent toilets mainly uses microwave and passive infrared sensors. Microwave sensors are omnidirectional sensors placed on the back side of the toilet. Since the omnidirectional microwave sensors have a wide field of view, people who wash their hands in the wash basins near the toilet but do not need to use the toilet will be mistakenly recognized and the toilet cover will be frequently lifted. Intelligent toilets that use passive infrared sensors have many disadvantages because the passive infrared sensors need to detect the motion of objects, when the object is not moving, the sensor cannot detect it.

SUMMARY

The present disclosure provides a control method for an intelligent toilet cover based on single infrared sensor, which can effectively solve the above problems.

The present disclosure is realized by the following solutions.

The present disclosure provides a control method for an intelligent toilet cover based on a single infrared sensor, comprising the following steps:

- sensing a human body approaching the intelligent toilet cover by an infrared sensor, and transmitting an approaching signal to a first control module to control a second opening/closing mechanism to lift the intelligent toilet cover, wherein the infrared sensor has a first sensing distance;
- controlling a sensing distance of the infrared sensor to shorten the sensing distance from the first sensing distance to a second sensing distance;
- sensing a hand motion signal by the infrared sensor and transmitting the hand motion signal to the first control module to control a first opening/closing mechanism to lift a toilet seat or to flush the toilet.

The present disclosure has the following advantages: the present disclosure provides a control method for an intelligent toilet cover based on a single infrared sensor which can solve the problems that microwave sensor has a wide field of view and that the passive infrared sensor cannot detect static objects by a directed infrared sensor. In addition, according to the present disclosure, the infrared sensor detects distance changing at different positions, so as to realize human body detection and hand motion detection by a single sensor, thereby achieving control of the toilet cover 12, toilet seat 11 and flushing, greatly saving costs and improving customer experience.

BRIEF DESCRIPTION OF THE DRAWINGS

In order to more clearly illustrate the technical solutions of the embodiments of the present disclosure, the drawings needed for illustration of the embodiments are briefly introduced below. It should be understood that the following drawings only show certain embodiments of the present disclosure and therefore should not be regarded as limiting the scope. For those of ordinary skill in the art, other related drawings can be obtained based on these drawings without creative efforts.

DETAILED DESCRIPTION OF THE EMBODIMENTS

In order to make the objectives, technical solutions and advantages of the embodiments of the present disclosure clearer, the technical solutions in the embodiments of the present disclosure will be clearly and completely described below in conjunction with the drawings in the embodiments of the present disclosure. Obviously, the described embodiments include part of the embodiments of the present disclosure rather than all. Based on the embodiments of the present disclosure, all other embodiments obtained by those of ordinary skill in the art without creative efforts should be considered as falling within the scope of protection of the present disclosure. Accordingly, the following detailed description of embodiments of the disclosure shown in the appended drawings is not intended to limit the scope of the disclosure but rather to represent selected embodiments of the disclosure. Based on the embodiments of the present disclosure, all other embodiments obtained by those of ordinary skill in the art without creative efforts should be considered falling within the scope of protection of the present disclosure.

In the description of the present disclosure, the terms "first" and "second" are used for descriptive purposes only and cannot be understood as indicating or implying relative importance or implicitly indicating the number of indicated technical features. Therefore, features defined as "first" and "second" may explicitly or implicitly include one or more of these features. In the description of the present disclosure, "plurality" means two or more, unless otherwise explicitly and specifically defined.

Figure 1:
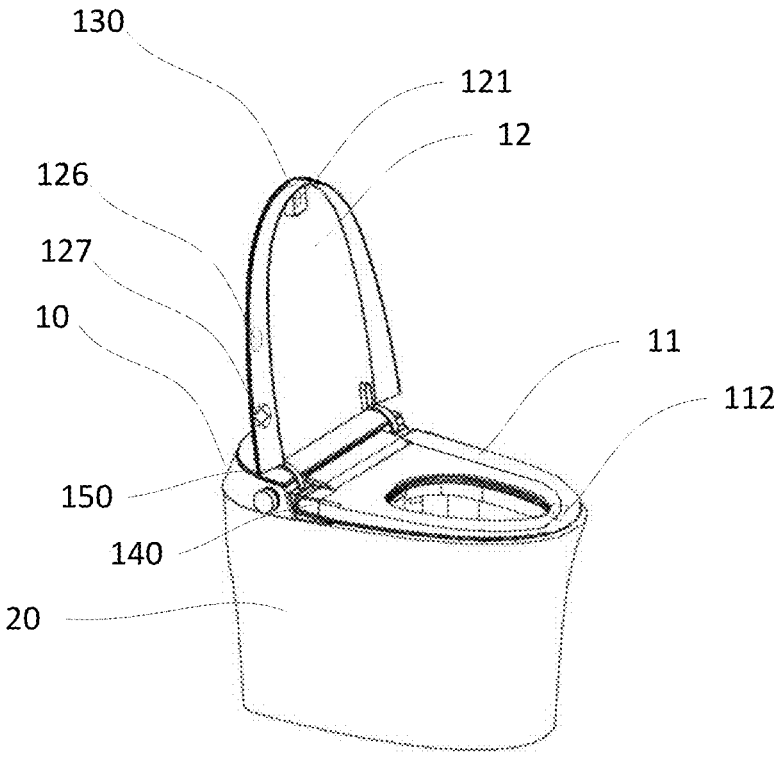
FIG. 1 is a structural schematic diagram of an intelligent toilet according to an embodiment of the present disclosure.
Figure 2:
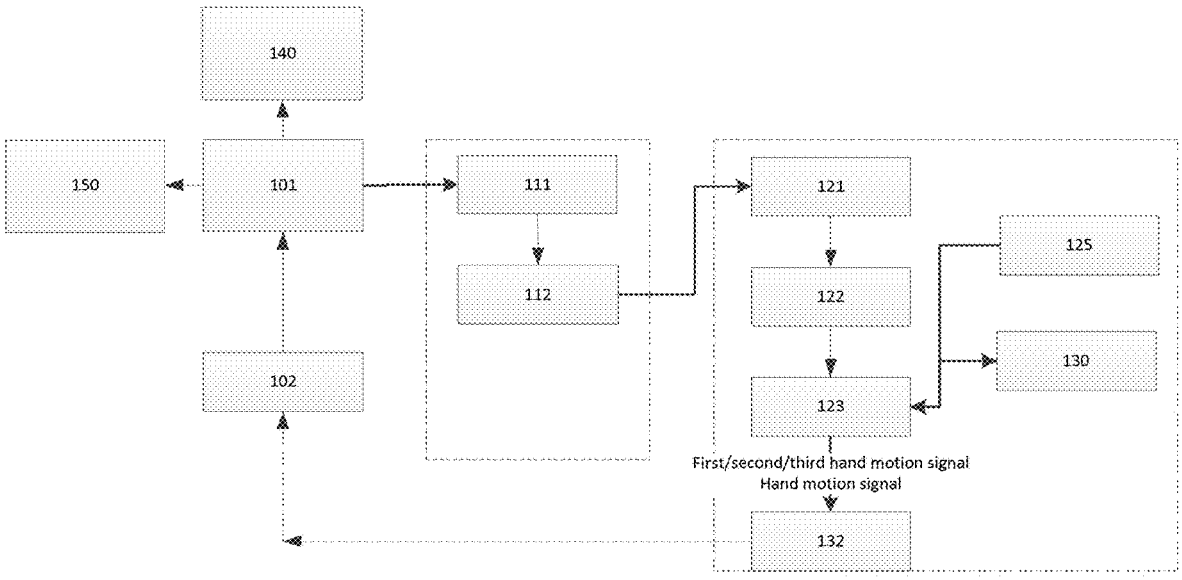
FIG. 2 is an architectural diagram of an intelligent toilet according to an embodiment of the present disclosure.

Referring to FIG. 1, an intelligent toilet according to an embodiment of the present disclosure includes:

- a toilet body 20;
  - a toilet cover body 10 arranged on the toilet body 20, wherein the toilet cover body 10 is provided with a first control module 101, a first opening/closing mechanism 140, a second opening/closing mechanism 150 and a second wireless communication module 102;
  - a seat 11 rotatably arranged on the first opening/closing mechanism 140, the seat 11 is provided with a wireless-charging transmitting circuit board 111 and a wireless-charging transmitter coil 112, and the wireless-charging transmitting circuit board 111 is electrically connected to the first control module 101;
  - a toilet cover 12 rotatably arranged on the second opening/closing mechanism 150, wherein the toilet cover 12 is capable of quick disassembling, the toilet cover 12 is electrically connected with a wireless-charging receiver coil 121, a wireless-charging receiver circuit board 122, a second control module 123, an energy storage module 125, infrared sensor 130, and a first wireless communication module 132 in communication connection with the second wireless communication module 102, when the toilet cover 12 is lowered, the wireless-charging receiver coil 121 and the wireless-charging transmitter coil 112 are arranged directly opposite to each other for charging and the electrical energy is stored in the energy storage module 125;

wherein the infrared sensor 130 is arranged on an outer surface of the toilet cover 12 and is configured to sense a human body that approaches the toilet, and the second control module 123 is configured to transmit an approaching signal to the first control module 101 through the communication module to control the second opening/closing mechanism 150 to lift the toilet cover 12; the infrared sensor 130 is further configured to sense a first hand motion signal, and the second control module 123 is further configured to transmit the first hand motion signal to the first control module 101 through the communication module to control the first opening/closing mechanism 140 to lift the seat 11. Namely, the first control module 101 is further configured to control the first opening/closing mechanism 140 to lift or lower the seat 11, and the first control module 101 is further configured to control the second opening/closing mechanism 150 to lift or lower the toilet cover 12.

The toilet cover body 10 may further be provided with a flushing mechanism (not shown in the drawing), and the first control module 101 is configured to control the flushing mechanism to perform women washing or hip washing after relieving the bowels. The toilet cover body 10 may further be provided with a drying mechanism (not shown in the drawing), and the first control module 101 is used to control the drying mechanism to perform drying operation after the cleaning is completed. The functions of the toilet cover body 10 are not limited to the above functions and are not restricted herein. The first opening/closing mechanism 140, the second opening/closing mechanism 150, the flushing mechanism and the drying mechanism are existing technologies and will not be described in detail herein.

Furthermore, the infrared sensor 130 is arranged on an outer side of the toilet cover 12 and is located at an end away from the toilet cover body 10. When a person approaches the infrared sensor 130, after the infrared sensor 130 detects a signal, human body approaching information will be sent to the second wireless communication module 102 by data transmitting of the first wireless communication module 132. The first control module 101 controls the second opening/closing mechanism 150 to lift the toilet cover 12. At this time, a sensing distance of the infrared sensor 130 can be shortened from a first sensing distance to a second sensing distance. The change of the sensing distance can be achieved by controlling the power or other methods (for example, it can be realized by keeping the power constant without imposing any control when the sensing distance is greater than the second sensing distance). The first sensing distance may be 1 meter to 5 meters; the second sensing distance may be 0 meter to 0.5 meters. Further, when the infrared sensor 130 detects the first hand motion signal, the first hand motion information will be sent to the second wireless communication module 102 by data transmitting of the first wireless communication module 132. The first control module 101 controls the first opening/closing mechanism 140 to lift the seat 11. Further, after urinating, the infrared sensor 130 again detects a second hand motion signal, the second hand motion information will be sent to the second wireless communication module 102 by data transmitting of the first wireless communication module 132. The first control module 101 controls the flushing mechanism to flush water, and the male finishes urinating. Finally, the second opening/closing mechanism 150 and the first opening/closing mechanism 140 are controlled to lower sequentially.

After someone relieving the bowels, the infrared sensor 130 detects a third hand motion signal, the third hand motion information will be sent to the second wireless communication module 102 by data transmitting of the first wireless communication module 132. The first control module 101 controls the flushing mechanism to flush water, and the bowel movement is finished. Finally, the second opening/closing mechanism 150 and the first opening/closing mechanism 140 are controlled to lower sequentially.

The first hand motion signal, the second hand motion signal and the third hand motion signal may be selected according to actual needs. In one embodiment, the first hand motion signal is a lateral movement, for example, sliding forward and backward in a lateral direction, or sliding left and right in the lateral direction; the second hand motion signal and the third hand motion signal may be the same or different. In one embodiment, the second hand motion signal and the third hand motion signal are the same, and they both are movements in a vertical direction. Specifically, the second hand motion signal and the third hand motion signal are both a downward movement similar to the action of pressing down to flush water.

In other embodiments, the seat 11 is further provided with a heating module (not shown in the drawing) electrically connected to the first control module 101 for heating up the seat 11 under the control of the first control module 101. The heating module also belongs to prior art and will not be described in detail herein.

As a further improvement, the wireless-charging transmitter circuit board 111 and the wireless-charging transmitter coil 112 are provided on the seat 11 at an end away from the toilet cover body 10. The wireless-charging receiver coil 121 and the wireless-charging receiver circuit board 122 are also correspondingly arranged on the toilet cover 12 at an end away from the toilet cover body 10, so that when the seat 11 and the toilet cover 12 are lowered, the distance between the seat 11 and the toilet cover 12 is the shortest, and when the toilet cover 12 is opened, the wireless-charging receiver coil 121 is away from the wireless-charging transmitter coil 112, thereby avoiding interference therebetween.

Figure 3:
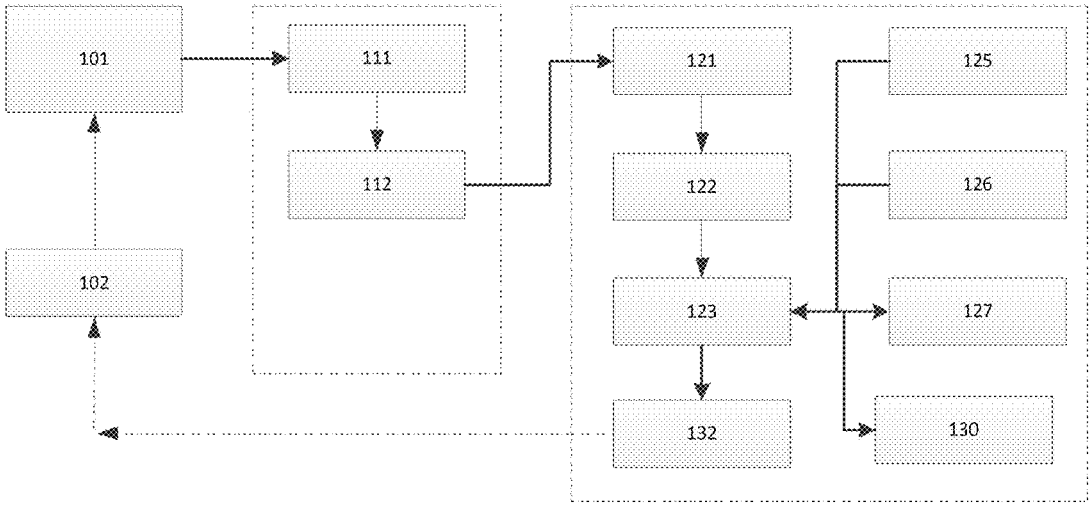
FIG. 3 is an architectural diagram of an intelligent toilet according to an embodiment of the present disclosure.

Referring to FIG. 3, as a further improvement, in other embodiments, the toilet cover 12 is further provided with an alarm module, and the alarm module includes an alarm button 126 and an alarm 127. By setting up the alarm module, if an emergency occurs when the elderly is using the toilet, the alarm module can be used to rise the alarm.

As a further improvement, in other embodiments, the toilet seat 12 is further provided with a music module (not shown in the drawing) connected to the second control module 123 to play music and the like.

Figure 4:
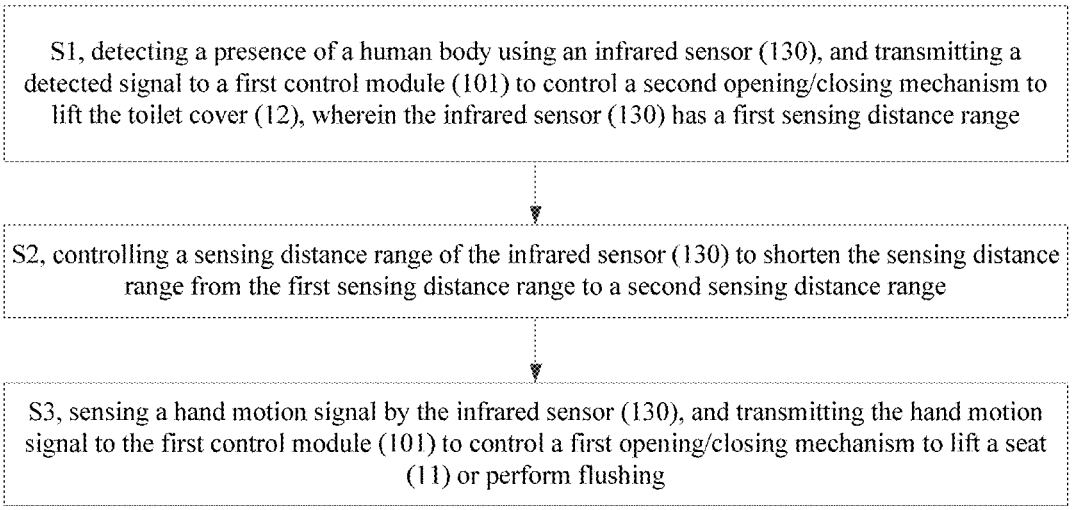
FIG. 4 is a flow chart of a control method for an intelligent toilet according to an embodiment of the present disclosure.

Referring further to FIG. 4, an embodiment of the present disclosure further provides a control method of an intelligent toilet cover which includes the following steps:

S1, sensing a human body approaching the intelligent toilet cover by an infrared sensor 130, and transmitting an approaching signal to a first control module 101 to control a second opening/closing mechanism 150 to open the toilet cover 12, wherein the infrared sensor 130 has a first sensing distance;

S2, controlling a sensing distance of the infrared sensor 130 to shorten the sensing distance from the first sensing distance to a second sensing distance;

S3, sensing a hand motion signal by the infrared sensor 130, and transmitting the hand motion signal to the first control module 101 to control a first opening/closing mechanism 140 to open a seat 11 or perform flushing.

In step S1, as a further improvement, the first sensing distance ranges between 1 meter to 5 meters. A relatively wide detection range can prevent false detection. Further, when the distance between the human body and the intelligent toilet cover is about 1 meter, the second opening/closing mechanism 150 is controlled to open the toilet cover 12. Generally speaking, the walking speed of a normal person is about 1 meter/second. Therefore, the toilet cover 12 being opened during 1 second can improve the user experience. It can be understood that when the toilet cover 12 is fully opened, the sensing area of the infrared sensor 130 changes from a lateral direction to a vertical direction.

In step S2, the height of a normal person is generally about 1.5 meters to 1.8 meters. At this time, the height of the infrared sensor 130 is about 1 meter, plus the length of the human arm is 0.5 meters to 1 meter. Therefore, the second sensing distance ranges between 0 meter to 0.5 meters. This makes it easier for people of different heights to use. It can be understood that by controlling the sensing distance of the infrared sensor 130 to shorten it from the first sensing distance to the second sensing distance, false detection of the ceiling or other bathroom devices such as water heater caused due to the excessive second sensing distance can be prevented.

As a further improvement, the step of controlling the sensing distance of the infrared sensor 130 to shorten the sensing distance from the first sensing distance to the second sensing distance includes:

decreasing the power of the infrared sensor 130 by controlling to shorten the sensing distance from the first sensing distance to the second sensing distance.

In other embodiments, as a further improvement, the step of controlling the sensing distance of the infrared sensor 130 to shorten the sensing distance from the first sensing distance to the second sensing distance includes:

filtering out signals of objects whose distance exceeds the second sensing distance by controlling the infrared sensor 130 to shorten the sensing distance from the first sensing distance to the second sensing distance.

In step S3, the step of sensing the hand motion signal by the infrared sensor 130 and transmitting the hand motion signal to the first control module 101 to control the first opening/closing mechanism 140 to open the seat 11 includes:

S31, sensing the first hand motion signal by the infrared sensor 130, and transmitting the first hand motion signal to the first control module 101 to control the first opening/closing mechanism 140 to open the seat 11, wherein the first hand motion signal being a motion in lateral direction.

As a further improvement, after the step of sensing the first hand motion signal by the infrared sensor 130 and transmitting the first hand motion signal to the first control module 101 to control the first opening/closing mechanism 140 to open the seat 11, the method further includes:

S32, sensing a second hand motion signal by the infrared sensor 130, and transmitting the second hand motion signal to the first control module 101 to perform flushing, wherein the second hand motion signal being a motion in vertical direction.

As a further improvement, the step of sensing the hand motion signal by the infrared sensor 130 and transmitting the hand motion signal to the first control module 101 to perform flushing includes:

S33, sensing a third hand motion signal by the infrared sensor 130, and transmitting the third hand motion signal to the first control module 101 to perform flushing, wherein the third hand motion signal being a motion in vertical direction.

The hand motion signal being a motion in vertical direction or a motion in lateral direction, and wherein the motion range exceeds a predetermined distance to prevent false detection and triggering. The predetermined distance may be 20 cm-40 cm which is set according to actual needs.

As a further improvement, after the flushing operation is completed, the method further includes:

S4: successively controlling the second opening/closing mechanism 150 and the first opening/closing mechanism 140 to lower the seat 11 and the toilet cover 12 in sequence.

As further improvements, the method further includes:

S5, determining whether a distance between the wireless-charging receiver coil 121 and the wireless-charging transmitter coil 112 is less than a predetermined distance, and if yes, start charging and storing the electric energy in the energy storage module 125.

As a further improvement, after the toilet cover 12 is lowered, the method further includes:

S6, controlling the sensing distance of the infrared sensor 130 to restore the sensing distance from the second sensing distance to the first sensing distance.

The above description merely involves preferred embodiment(s) of the present disclosure and is not intended to limit the present disclosure. For those skilled in the art, the present disclosure may have various modifications and variations. Any modification, equivalent substitution, improvement, etc. made within the spirit and principle of the present disclosure shall be considered as falling within the scope of protection of the present disclosure.

What is claimed is:

1. A control method for an intelligent toilet cover based on a single infrared sensor, comprising the steps of:

detecting a presence of a human body using an infrared sensor (130), and transmitting detected signal to a first control module (101) to control a second opening/closing mechanism to lift the toilet cover (12), wherein the infrared sensor (130) has a first sensing distance range;

controlling a sensing distance range of the infrared sensor (130) to shorten the sensing distance range from the first sensing distance range to a second sensing distance range; and sensing a hand motion and generating a hand motion signal by the infrared sensor (130), and transmitting the hand motion signal to the first control module (101) to control a first opening/closing mechanism to lift a seat (11) or to perform flushing, then controlling the second opening/closing mechanism and the first opening/closing mechanism to lower the seat (11) and the toilet cover (12).

2. The control method for the intelligent toilet cover according to claim 1, wherein the first sensing distance range is between 1 meter to 5 meters, and the second sensing distance range is between 0 meter to 0.5 meters.

3. The control method for the intelligent toilet cover according to claim 1, wherein the step of sensing the hand motion signal by the infrared sensor (130) and transmitting the hand motion signal to the first control module (101) to control the first opening/closing mechanism to lift the seat (11) comprises:

sensing the first hand motion signal by the infrared sensor (130), and transmitting the first hand motion signal to the first control module (101) to control the first opening/closing mechanism to lift the seat (11), wherein the first hand motion signal being a motion in lateral direction.

4. The control method of the intelligent toilet cover according to claim 3, wherein after the step of sensing the first hand motion signal by the infrared sensor (130) and transmitting the first hand motion signal to the first control module (101) to control the first opening/closing mechanism to lift the seat (11), the method further comprises:

sensing a second hand motion signal by the infrared sensor (130), and transmitting the second hand motion signal to the first control module (101) to perform flushing, wherein the second hand motion signal being a motion in vertical direction.

5. The control method of the intelligent toilet cover according to claim 2, wherein the step of sensing the hand motion signal by the infrared sensor (130) and transmitting the hand motion signal to the first control module (101) to perform flushing includes:

sensing a third hand motion signal by the infrared sensor (130), and transmitting the third hand motion signal to the first control module (101) to perform flushing, wherein the third hand motion signal being a motion in vertical direction.

6. The control method of the intelligent toilet cover according to claim 1, wherein the hand motion signal being a motion in vertical direction or a motion in lateral direction, and wherein the motion range exceeds a predetermined distance to prevent false detection and triggering.

7. The control method of the intelligent toilet cover according to claim 1, wherein the method further comprises:

determining whether a distance between a wireless-charging receiver coil (121) and a wireless-charging transmitter coil (112) is less than a predetermined distance, and if yes, start charging and storing electric energy in an energy storage module (125).

8. The control method of the intelligent toilet cover according to claim 1, wherein after the toilet cover (12) is lowered, the method further comprises:

controlling the sensing distance range of the infrared sensor (130) to restore the sensing distance range from the second sensing distance range to the first sensing distance range.

9. The control method of the intelligent toilet cover according to claim 1, wherein the step of controlling the sensing distance range of the infrared sensor (130) to shorten the sensing distance range from the first sensing distance range to the second sensing distance range comprises:

decreasing a power of the infrared sensor (130) to shorten the sensing distance range from the first sensing distance range to the second sensing distance range.

* * * * *